US005643043A

United States Patent [19]

Pflum

[11] Patent Number: 5,643,043

[45] Date of Patent: Jul. 1, 1997

[54] BRASSIERE FOR FEMALE ATHLETES

[76] Inventor: Trish Winsche Pflum, c/o Dr. Francis Pflum 20 W. 13th St., New York, N.Y. 10011

[21] Appl. No.: 454,824

[22] Filed: May 31, 1995

[51] Int. Cl.[6] ..... A41B 3/00; A41B 3/12

[52] U.S. Cl. ..... 450/86; 2/73; 450/62; 450/63; 450/65; 450/78

[58] Field of Search ..... 2/73, 105, 106, 2/113, 115; 450/59, 60, 61, 62, 63, 65, 67, 68, 70, 71, 72, 73, 77, 78, 86

[56] References Cited

U.S. PATENT DOCUMENTS

| | | | |
|---|---|---|---|
| 2,100,890 | 11/1937 | Witkower | 450/61 X |
| 2,333,434 | 11/1943 | Middlecoff | 450/55 |
| 2,362,974 | 11/1944 | Cohen | 450/59 |
| 2,421,448 | 6/1947 | Witkower | 450/63 |
| 2,431,829 | 12/1947 | Redares | 450/59 |
| 2,553,225 | 5/1951 | Weaver et al. | 450/61 X |
| 2,607,038 | 8/1952 | Spare | 450/59 |
| 2,867,516 | 1/1959 | Champagne et al. | 450/77 X |
| 3,200,821 | 8/1965 | Anderson | 450/68 |

OTHER PUBLICATIONS

Gershman, Maurice, "Self Adhering Nylon Tapes", The J.A.M.A., vol. 168, No. 7, p. 930, Oct. 1958.

*Primary Examiner*—Jeanette E. Chapman
*Attorney, Agent, or Firm*—White & Case

[57] ABSTRACT

A brassiere for use by female athletes, which brassiere, by unique use of elastic type panel members located in the upper portion of the brassiere and removably and variably affixed by means to the brassiere shoulder strap, prevents bouncing of the breasts, and accomplishes this prevention of bouncing by compression downwards from the upper surface of the breast; and further said elastic type panel member is held in position relative to the balance of the brassiere by means; and further the upper surface of the brassiere has an enclosed bivalved pocket for the insertion of a contoured pad to optimize downward pressure distribution on the breast and to enhance appearance and comfort.

6 Claims, 7 Drawing Sheets

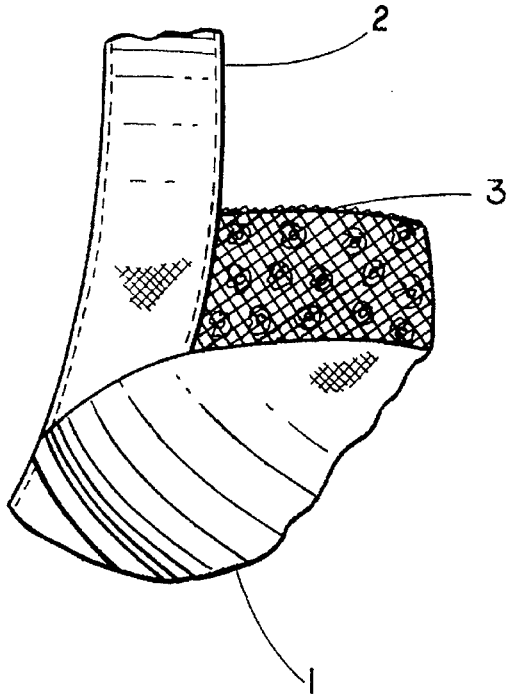
FIG. 5
FIG. 6
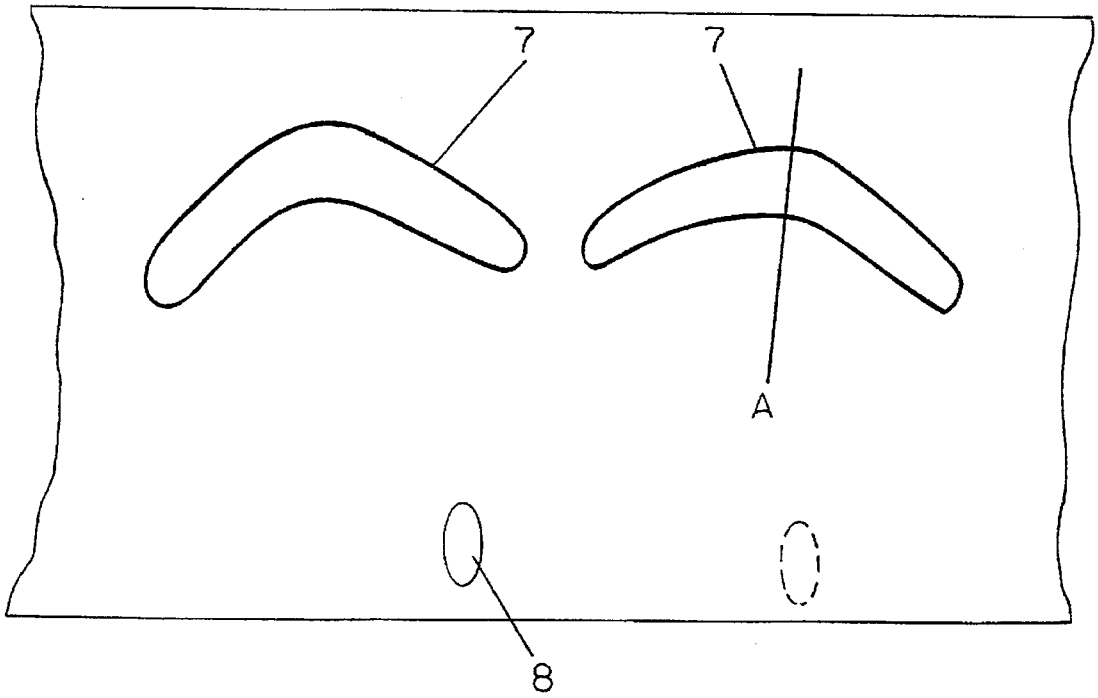

BRASSIERE FOR FEMALE ATHLETES

BACKGROUND—FIELD OF INVENTION

This invention is of a brassiere for use by a female athlete, which brassiere, by unique use of variably affixable elastic type panel members in the upper portion of the brassiere, prevents bouncing of the breasts, and accomplishes this prevention of bouncing by compression downward from the upper surface of the breast; and further the said elastic type panel member is held in position relative to the balance of the brassiere by means; and further the upper surface of the brassiere has an enclosed pocket into which is inserted a contoured pad to optimally distribute to and along the upper surface of the breast the said downward pressure and to shape, form and enhance the physical appearance of the breast of the wearer, thereby creating an attractive appearance of the wearer of the athletic brassiere. The said upper surface pressure is resisted by the inferior aspect of the brassiere which is constructed in a fashion to preserve desirable appearance and comfort.

BACKGROUND—PRIOR ART

There has been a massive increase in the number of women engaged in athletic activities. The need for an athletic Brassiere is undeniable and has been addressed in the past.

The problems associated with presently available brassieres is both comfort and appearance. Conventional brassieres do not hold the breasts firmly allowing movement which may be painful, awkward and cause premature breakdown of tissues.

Athletic brassieres up to this time have attempted to solve the problem either by compression of the whole breast against the chest wall or support of only the undersurface of the breast, leaving the breast free to lift vertically (although not free to fall vertically).

I believe that this approach is not only ineffective but also creates a defeminizing unattractive appearance.

In addition, all brassieres known today have as their objectives the uplifting of the breasts; my invention is unique in that it has as its objective limiting the vertical "uplift" of the breast by holding the breast down rather than lifting the breast up.

I am aware of certain brassiere related devices which are encompassed by previously issued United States Letters Patents; my invention is quite different from any such devices, and my invention is superior to any such devices.

I am aware of U.S. Pat. No. 2,301,499 issued to L. J. A. Amyot on Nov. 10, 1942. My invention is distinguished from and superior to this Amyot Patent by virtue of the following.

The Amyot invention is limited to being a device to provide that "... the breasts are given an exceptionally high, well separated and rounded appearance . . . ", and is thus entirely aesthetic in its objective and result. My invention is primarily functional, with the purpose being to provide comfortable support and movement restraint to the female athletes breasts and thereby avoid premature tissue breakdown.

I am aware of U.S. Pat. No. 2,333,434 issued to L. H. Middlecoff on Nov. 2, 1943. My invention is distinguished from and superior to this Middlecoff Patent by virtue of the following.

The Middlecoff invention relates to improvement in the bra pads, the object being to restore the natural and desired contours of the breast. My use of pads is for a different purpose. The pads used in my invention is to enhance compression downward in an effort to reduce breast bounce with a minimum of discomfort. Admittedly the structure may be similar and its use may improve appearance but the use of a pad is not my invention. Middlecoff accepts in her patent that pads have bene used prior to her invention. My invention uses a pad on the upper surface of the breast but only under the elastic panel and the two together are the means of accomplishing my objective of decreasing breast bounce. This is a unique use not anticipated by Middlecoff.

I am aware of U.S. Pat. No. 2,363,017 issued to H. M. Plehn on Nov. 21, 1944. My invention is distinguished from and superior to this Plehn Patent by virtue of the following.

The Plehn invention is of a brassier shoulder strap construction, which does not directly relate to my invention except to the peripheral extent that the athletic brassiere of my invention also has straps, which straps are not claimed by me as part of my invention.

I am aware of U.S. Pat. No. 2,400,499 issued to E. Gerace on May 21, 1946. My invention is distinguished from and superior to this Gerace Patent by virtue of the following.

The Gerace invention is of a device to separate the breasts and to raise the points thereof; it is merely to achieve a decorative effect and is not functional. My invention in comparison is primarily functional, and rather than merely providing for a chamber into which the breast is inserted, it provided positive gentle pressure of the breasts by means of an elastic band border to positively retrain the breast from movement.

In addition, the Gerace invention is of a device which is complex to manufacture, difficult for the wearer to use, and is uncomfortable for the wearer to use.

I am aware of U.S. Pat. No. 2,431,829 issued to R. J. Redares on Dec. 2, 1947. My invention is distinguished from and superior to this Redares Patent by virtue of the following.

The Redares invention relates to improving upon the then current brassiere circa 1945, which is now quite obsolete. His stated objective " . . . of this invention is to make it possible to support the brassiere firmly upon the bust without imposing any forces upon the breast cups such as would tend to flatten the breasts, or otherwise produce a distorting pressure thereon" speaks for itself.

I am aware of U.S. Pat. No. 2,553,225 issued to R. B. Weaver et al on May 15, 1951. My invention is distinguished from and superior to this Weaver Patent by virtue of the following.

The Weaver invention has to do with a brassiere which was "simple, effective and comfortable"; my invention is specifically to prevent bouncing of the breasts. Weavers object was to provide a brassiere with "few simple parts" that would be "most effective as a support." Another object of Weaver was to use "crossed slings". It is noteworthy that a sling is a strap like device used to suspend or hang something. In no sense of the word have slings ever been used to effect a force such as compression.

As described the "crossed slings" of Weaver are narrow elongated elements having their lower ends anchored below and lateral to the breast, they extend horizontally toward each other, "cross at the front of the wearer" and extend up to the opposite shoulder straps. My elastic panels originate and are exclusive to the upper surface of the breasts. The "elastic section" of Weaver is an option in the preferred embodiment and not a necessary component. My elastic panel is a necessity and must be much larger than that of Weaver. The "elastic section" of Weaver is used to facilitate alteration in the length of the slings for the purpose of increasing the suspensory effect on the under surface of the breast on the opposite side that the elastic is on. My invention is to have the larger, wider elastic panel press downward, compressing the upper surface of the breast on the same side as the elastic panel.

I am aware of U.S. Pat. No. 2,773,261 issued to T. B. Schaumer on Dec. 11, 1956. My invention is distinguished from and superior to this Schaumer Patent by virtue of the following.

The Schaumer invention is essentially merely a design, albeit clever, which incorporates the brassiere shoulder strap into and as an integral part of the bottom portion of the brassiere breast retention cup. It does not provide any positive pressure on the breast for retention during vigorous vertical movement of the body of the wearer. My invention in comparison, does positively restrain the breast from such movement.

I am aware of U.S. Pat. No. 2,864,375 issued to P. J. Steinmetz on Dec. 16, 1958. My invention is distinguished from and superior to this Steinmetz Patent by virtue of the following.

The Steinmetz invention is essentially of a novel self-adjusting shoulder strap, to allow the position of the brassiere on the wearer to return to its initial position on the wearer after a stretching movement by the wearer. Steinmetz neither duplicates nor anticipates my invention, which does not directly relate to a brassiere strap.

I am aware of U.S. Pat. No. 2,929,669 issued to M. P. Strauss on May 5, 1958. My invention is distinguished from and superior to this Strauss Patent by virtue of the following.

The Strauss invention is essentially to prevent brassiere shoulder straps from slipping off the shoulder of the wearer. Strauss neither duplicates nor anticipates my invention, which does not directly relate to prevention of brassiere strap slippage.

I am aware of U.S. Pat. No. 3,008,468 issued to H. K. Williams on Nov. 14, 1961. My invention is distinguished from and superior to this Williams Patent by virtue of the following.

The Williams invention is essentially of a shoulder brace brassiere intended to improve the posture of the wearer. Williams neither duplicates nor anticipates my invention, which does not relate to the posture of the wearer.

I am aware of U.S. Pat. No. 3,075,530 issued to R. K. Smith on Jan. 29, 1963. My invention is distinguished from and superior to this Smith Patent by virtue of the following.

The Smith invention is essentially of a strapless brassiere. Smith neither duplicates nor anticipates my invention, which does not relate to a brassiere being strapless, and in fact requires brassiere straps.

I am aware of U.S. Pat. No. 3,439,682 issued to A. C. Defru on Apr. 22, 1969. My invention is distinguished from and superior to this Defru Patent by virtue of the following.

The Defru invention is essentially a standard brassiere with the only noticeable difference being the use of stiffened laminated members for the framework of the breast retention cups, thereby providing a solid frame but a soft, somewhat flexible breast retention cup, not markedly different than a standard brassiere. The objective of the Defru invention is to eliminate wires and bones. Defru neither duplicates nor anticipates my invention, which does not relate to the use of stiffened laminated members for the framework of the breast retention cups, not to bones or wires.

I am aware of U.S. Pat. No. 3,623,487 issued to Winston C. Chiu on Nov. 31, 1971. My invention is distinguished from and superior to this Chiu Patent by virtue of the following.

The Chiu invention is essentially a device for buckling, closing and adjusting certain garments, including brassieres. In the Chiu invention, although there is depicted elastic material between and connecting the brassiere breast cups, that elastic material is for the limited purpose of comfortably maintaining the relative positions of the cups and not to restrain the breasts themselves within the cups; indeed, in the Chiu invention, the elastic material never comes into contact with the breast, whereas in my invention, there is direct and positive contact between the elastic material and the breasts. Chiu neither duplicates nor anticipates my invention, which does not relate to buckling, closing and adjusting a brassiere.

I am aware of U.S. Pat. No. 3,665,929 issued to Newby O. Brantly on May 30, 1972. My invention is distinguished from and superior to this Brantly Patent by virtue of the following.

Brantly teaches the use of a single elastic band around the lower edge of the brassiere. Brantly neither duplicates nor anticipates my invention. My invention teaches the use of elastic members as the upper most component of the brassiere breast retention cup, not to keep the cup snugly held in place, but to directly keep the upper portion of the breast held gently but firmly in place.

I am aware of U.S. Pat. No. 3,717,154 issued to Mack Spetalnik on Feb. 20, 1973. My invention is distinguished from and superior to this Spetalnik Patent by virtue of the following.

Spetalnik teaches the use of elastic brassiere retention cups, shirred or gathered at the top to tightly fit the breasts. The use of Elastic cups is very uncomfortable to wear due to heat and moisture retention, in addition to the breasts being squeezed by the elastic. My invention uses a conventionally fabricated cup, made of cotton, silk, nylon or such, with that fabric being in substantial direct contact with the breast; my invention uses elastic only as a border across the upper edge of the cup, with the elastic in my invention not being used for the cup itself, but merely as a retention means to hold the breast from bounding out of the top of the cup.

I am aware of U.S. Pat. No. 3,763,865 also issued to Albert C. DeFru on Oct. 9, 1973. My invention is distinguished from and superior to this 1973 DeFru Patent by virtue of the following.

The DeFru 1973 invention is essentially a strapless brassiere, with the additional nuance of being readily able to expose the nipple to create a "no bra" effect. DeFru neither duplicates nor anticipates my invention, which does not relate to a strapless brassiere, and in fact, my invention needs a brasserie with a strap.

To the extent that DeFru addresses the use of a "cradle strap", it is distinct and inferior to the use of the elastic border band of my invention. The DeFru cradle strap provides no direct pressure on the breast, nor does it encapsulate the entire breast, but merely a small portion thereof in shoe-lace fashion. My invention provides gently firm pressure on the entire breast, which is more comfortable and more effective in retaining the entire breast, rather than subjecting the breast to the whiplash effect of the DeFru invention if worn by a female athlete.

I am aware of U.S. Pat. No. 3,814,107 issued to Irwin Greenblatt and Nicholas A. Marino on Jun. 4, 1974. My invention is distinguished from and superior to this Greenblatt Patent by virtue of the following.

The Greenblatt invention is essentially a padded brassiere with certain rubber material like components. Although it is contended by Greenblatt that the Greenblatt invention prevents relative movement between the breast and the cup, that conclusion is without any support. The cups supposedly are not moved in relation to movement of the brassiere support straps.

However, the gusset of the Greenblatt invention does not contain and restrain the breasts but merely maintains the relative position of the brassiere shoulder straps. Accordingly, Greenblatt neither duplicates nor anticipates my invention.

I am aware of U.S. Pat. No. 3,911,931 issued to Bernard Pundyk on Oct. 14, 1975. My invention is distinguished from and superior to this Pundyk Patent by virtue of the following.

The Pundyk invention is essentially the displacement of the stitches of the fabric components of a brassiere to facilitate shape of the encased observed breast and to avoid direct contact between the stitches and the nipple. Pundyk neither duplicates nor anticipates my invention.

I am aware of U.S. Pat. No. 3,976,083 issued to Jakob E. Schmidt on Aug. 24, 1976. My invention is distinguished from and superior to this Schmidt Patent by virtue of the following.

The Schmidt invention is essentially of a brassiere with a nipple like proturbance for appearance enhancement to create the illusion of "no bra". Schmidt neither duplicates nor anticipates my invention.

I am aware of U.S. Pat. No. 4,127,128 also issued to Jakob E. Schmidt on Nov. 28, 1978. My invention is distinguished from and superior to this 1978 Schmidt Patent by virtue of the following.

This Schmidt invention is essentially of a brassiere with a simulated and/or attachable/removable nipple simulator for appearance enhancement to create the illusion of "no bra". Schmidt neither duplicates nor anticipates my invention.

I am aware of U.S. Pat. No. 4,174,717 issued to Hinda W. Schreiber, Eugenie Z. Lindahl and Polly P. Smith on Nov. 20, 1979. My invention is distinguished from and superior to this Schreiber Patent by virtue of the following.

The Schreiber invention, although named as an Athletic Brassiere, is essentially merely the equivalent of a sleeveless tee shirt, with no breast retention cups, made of elastic material with a high waisted belt, with the breasts merely pressed flat against the wearer chest. Schneider neither duplicates nor anticipates my invention.

I am aware of U.S. Pat. No. 4,241,737 also issued to Jakob E. Schmidt on Dec. 30, 1980. My invention is distinguished from and superior to this 1980 Schmidt Patent by virtue of the following.

This Schmidt invention is essentially of a brassiere with a simulated and/or attachable/removable nipple simulator for appearance enhancement to create the illusion of "no bra". Schmidt neither duplicates nor anticipates my invention.

I am aware of U.S. Pat. No. 4,289,137 issued to Dorothy G. Dell and Christine H. Clifford on Sep. 15, 1981. My invention is distinguished from and superior to this Dell Patent by virtue of the following.

The Dell invention of a sports brassiere, teaches the use of an upper cup made of a material that "resists substantial stretching and therefore limits upward bouncing" of the breasts, but it conspicuously fails to disclose how the mere use of a "resistant material" renders the Dell brassiere any different than a standard brassiere. My invention provides for elastic components across the upper portion of the cups, thereby placing positive downward pressure on the breast to assure that they remain immobile. This downward pressure is also enhanced by the insert pad, when pad also enhances physical appearance of the wearer. In addition, my invention provides for the elastic members to be adjustable, to provide for different levels of this pressure.

I am aware of U.S. Pat. No. 4,311,150 also issued to Hinda W. Schreiber, Eugenie Z. Lindahl and Polly P. Smith on Jan. 19, 1982. My invention is distinguished from and superior to this 1982 Schreiber Patent by virtue of the following.

This Schreiber invention, although named as an Athletic Brassiere, is essentially identical to the 1979 Schrieiber invention, and is merely the equivalent of a sleeveless tee shirt, with no breast retention cups, made of elastic material with a high waisted belt, with the breasts merely pressed flat against the wearer chest. Schneider neither duplicates nor anticipates my invention.

I am aware of U.S. Pat. No. 4,314,569 issued to Joanne E. Speno on Feb. 9, 1982. My invention is distinguished from and superior to this Speno Patent by virtue of the following.

The Speno invention is essentially to offset the fabric seams in the brassiere construction to thereby avoid contact between the nipples and the seams. Speno neither duplicates nor anticipates my invention.

I am aware of U.S. Pat. No. 4,324,254 issued to Murray Freedman, Arthur E. Vale, and Peter R. Vale on Apr. 13, 1982. My invention is distinguished from and superior to this Freedman Patent by virtue of the following.

The Freedman invention is essentially of a brassiere, the breast cups of which are constructed of a relatively rigid or fixed material which breast cups are affixed to an elastic type means to connect the said breast cups to each other and to hold the said breast cups in a fixed position on the body of the wearer notwithstanding movement of the wearer. Freedman addresses the position of the breast cups in relation to the breasts and the body, and does not encompass the concept of restraining movement of the breasts, which restraint of breast movement is the objective and accomplishment of my invention. Accordingly, Freedman neither duplicates nor anticipates my invention.

I am aware of U.S. Pat. No. 4,607,640 issued to LeRoy H. McCusker on Aug. 26, 1986. My invention is distinguished from and superior to this McCusker Patent by virtue of the following.

The McCusker invention is essentially a "protective" brassiere which is the brassiere equivalent of the factory workers steel toed shoe; it is a rigid encasement into which the breasts are, in effect, inserted. The feasibility of the McCusker invention being used by an encaged female athlete is difficult to comprehend. McCusker neither duplicates nor anticipates my invention.

I am aware of U.S. Pat. No. 5,037,348 issued to Frank G. Farino on Aug. 6, 1991. My invention is distinguished from and superior to this Farino Patent by virtue of the following.

The Farino invention is of a therapeutic brassiere specifically for supporting breast implants, and is not intended for female athletes. Farino specifically teaches the use of a material which conforms to the body shape without exerting pressure; in comparison, my invention specifically dictates downward pressure on the top side of the breasts to positively hold them in position within the brassiere retention cups. The Farino invention is used in conjunction with a strapless brassiere; my invention uses brassiere shoulder straps to hold and anchor the elastic material to enable it to exert positive downward pressure on the restrained breasts. The elastic material as used in the Farino invention provides no positive pressure and would not function to sufficiently restrain and contain the breast in active vigorous use by the wearer. Farino neither duplicates nor anticipates my invention.

I am aware of U.S. Pat. No. 5,098,331 issued to Mark W. Corrado on Mar. 24, 1992. My invention is distinguished from and superior to this Corrado Patent by virtue of the following.

The Corrado invention, which is of a surgical chest dressing, is strikingly similar to the Farino Patent discussed immediately above herein. Accordingly, for the same reasons that my invention is not anticipated by of duplicative of the Farino invention, my invention is also not anticipated by of duplicative of the Corrado invention. In addition, the Corrado invention is not intended for female athletes; the Corrado Patent specifically provides that it is applicable to patients of either sex.

I am aware of U.S. Pat. No. 5,149,293 issued to Lisa Gable on Sep. 22, 1992. My invention is distinguished from and superior to this Gable Patent by virtue of the following.

The Gable invention is essentially a belt-like brassiere accessory, the function of which is to maintain should straps in position. Gable neither duplicates nor anticipates my invention.

I am aware of U.S. Pat. No. 5,221,227 issued to Dia L. Michels on Jun. 22, 1993. My invention is distinguished from and superior to this Michels Patent by virtue of the following.

The Michels invention is of a brasserie which is claimed to be multi-functional, supposedly being useful for such diverse and contradictory activities as jogging and nursing. It has the physical appearance of a campers back-pack being worn 180 degrees out of proper alignment. The Michels invention is noticeably devoid of allowing any aesthetic design of a brassiere encompassing the teaching of the Michels invention. Michels neither duplicates nor anticipates my invention.

I am aware of U.S. Pat. No. 5,244,432 issued to May N. Moy Au and Sheryl Unsworth on Sep. 14, 1993. My invention is distinguished from and superior to this Moy Au Patent by virtue of the following.

The Moy Au invention is of a "protective" brassiere during activities of high physical contact, using rigid shock absorbing cups. It does not provide the restraint of vertical movement of my invention. Moy Au neither duplicates nor anticipates my invention.

I am aware of U.S. Pat. No. 5,269,720 issued to Herbert L. Moretz and Daniel L. Brier on Dec. 14, 1993. My invention is distinguished from and superior to this Moretz Patent by virtue of the following.

The Moretz invention is of a moisture management brassiere, with a moisture transport layer for use during the late stages of pregnancy. Moretz neither duplicates nor anticipates my invention.

I am also aware of the following United States Patents, all of which although disclosing an adjustable length strap on the brassiere do not have as their objective and accomplishment the same objective and accomplishment as my invention, to wit, downward pressure on the breast:

U.S. Pat. No. 2,362,974 issued to D. I. Cohen on Nov. 21, 1944;

U.S. Pat. No. 2,867,216 issued to E. C. Champagne et al on Jan. 6, 1959;

U.S. Pat. No. 2,607,038 issued to L. Spare on Aug. 19, 1952;

U.S. Pat. No. 3,200,821 issued to R. F. Anderson on Aug. 17, 1965;

U.S. Pat. No. 2,100,890 issued to M. Witkower on Nov. 30, 1937;

U.S. Pat. No. 2,421,448 issued to Max Witkower on Jun. 3, 1947.

OBJECTS AND ADVANTAGES

The primary objective of my invention is to provide a means for a female athlete to exercise vigorously (under which circumstances her breasts are subject to rapidly changing upward and downward directions) as for example in jumping or jogging, while restraining the otherwise movement of the breasts in relation to the torso and thereby protecting the breasts from otherwise premature tissue breakdown.

My invention is a modified brassiere, which modification provides for downward pressure on the upper portion of the breasts, which pressure comfortably restrains and prevents undue movement of the breasts as the wearer of the brassiere is rapidly moving in an oscillating vertical manner. The extent and degree of this pressure is determined by the wearer, who chooses so by selecting the specific position at which the elastic type panel member at the upper surface of the breast retention cups are removably and variably affixed to the shoulder strap of the brassiere.

My invention is significantly advantageous in comparison to any other means of limiting the movement of the breasts are comfort to the wearer and ease of fabrication of the device.

In addition, my invention also provides a means, through pockets in the brassiere into which contoured pads are inserted, for optimally distributing to and along the upper surface of the breast downward pressure and to shape, form and enhance the physical appearance of the breast of the wearer, thereby creating an attractive appearance of the wearer of the athletic brassiere.

BRIEF DESCRIPTIONS OF THE DRAWINGS

Figure 1:
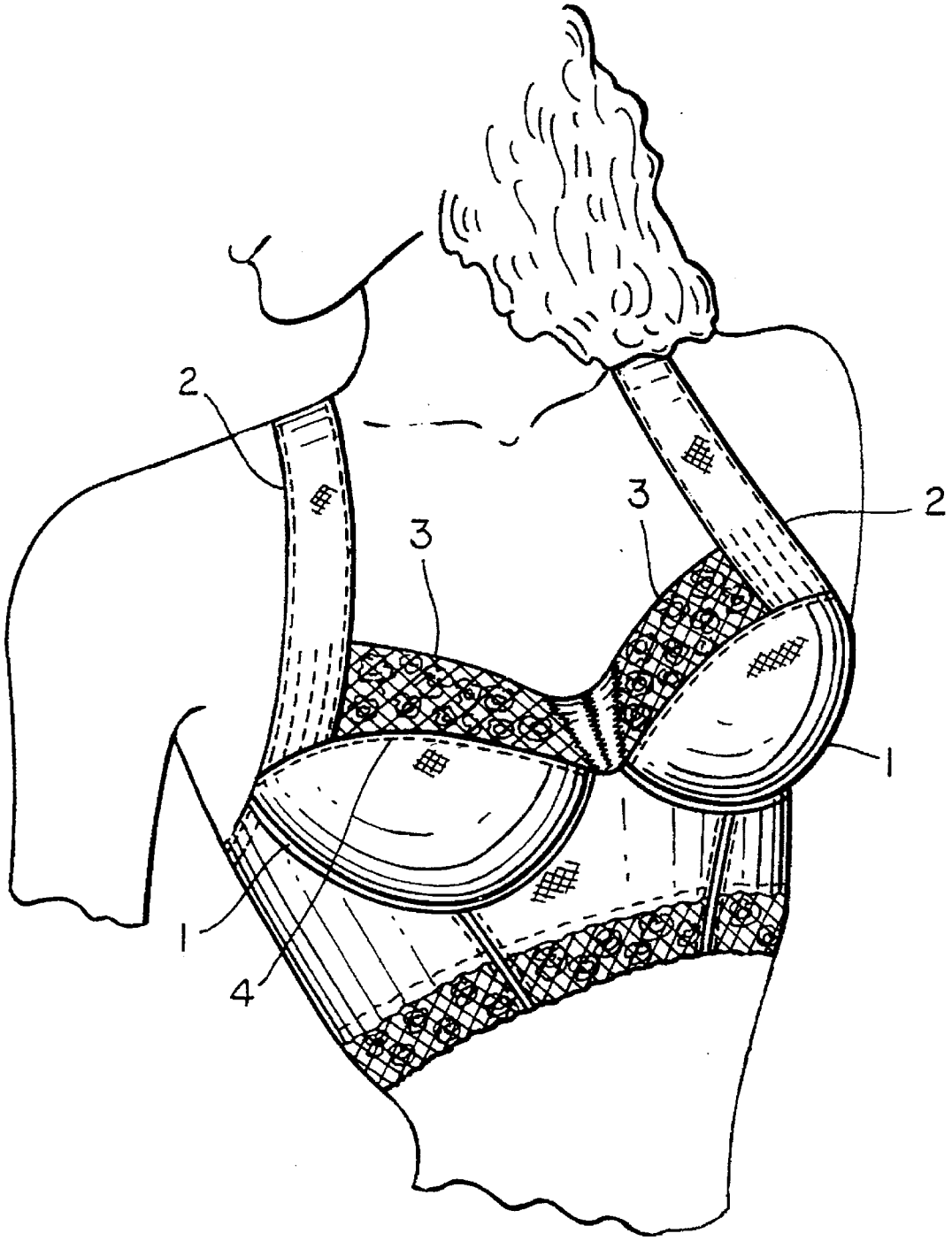
FIG. 1 is a frontal view of a brassiere incorporating a typical embodiment of the invention.
Figure 2:
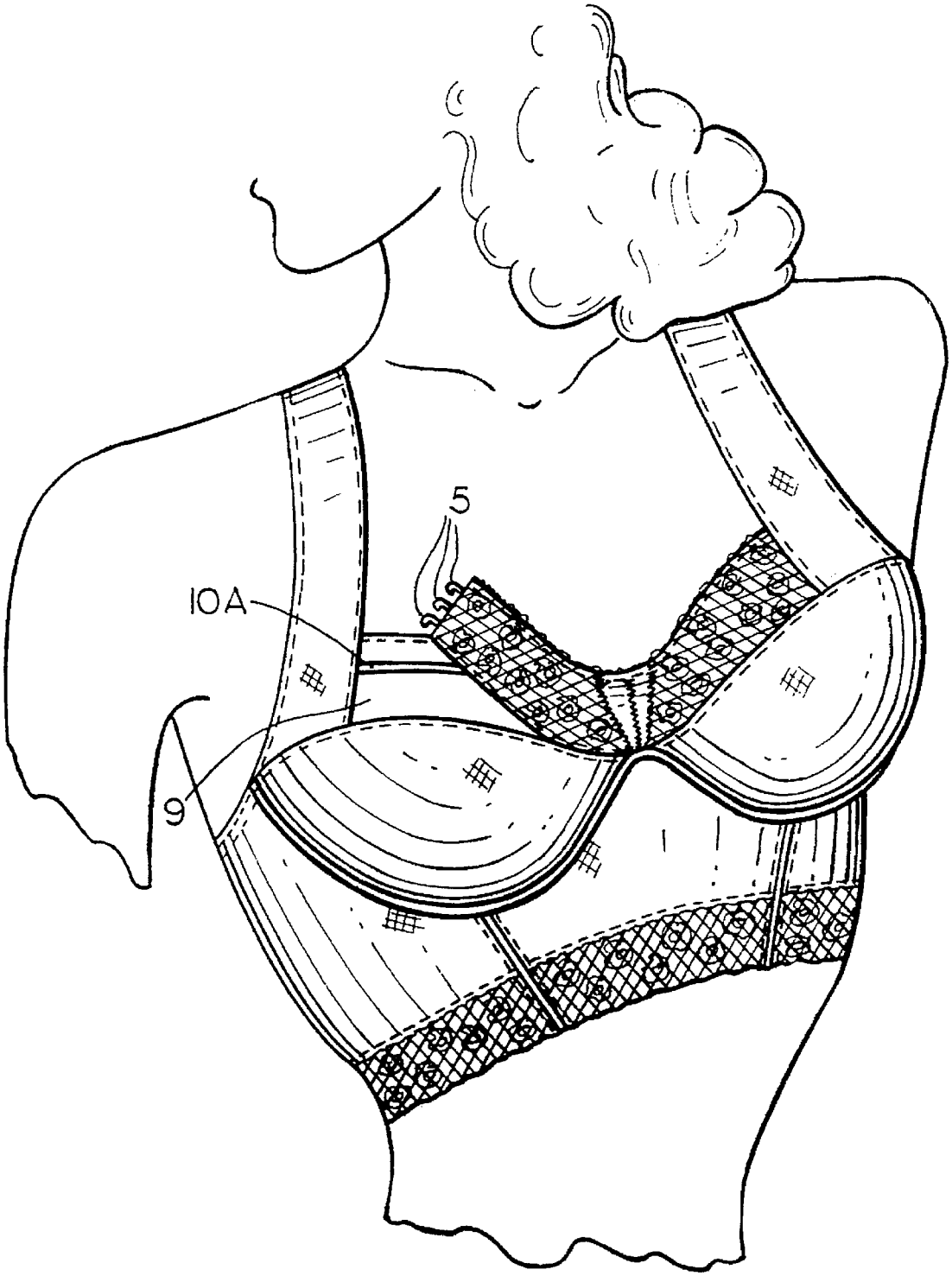
FIG. 2 is a modification of FIG. 1 illustrating the positioning of the elastic type panel member as a component of the brassiere and depicting one embodiment of the invention in which the means of removably and variably affixing the elastic type panel member of the brassiere to the brassiere shoulder strap is depicted as a series of hooks and eyelets.
Figure 3:
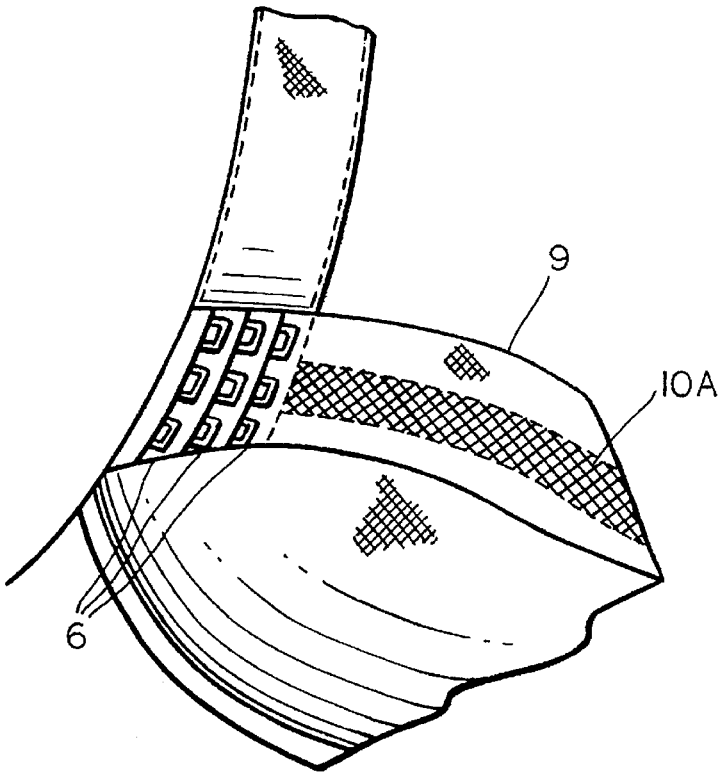

FIG. 3 is a close-up depiction of a section of FIG. 2, illustrating one embodiment of the invention, magnified to clearly depict at the interface of the shoulder strap and the upper breast surface contact soft fabric panel of the brassiere, in this preferred embodiment of the invention, the multiple rows of eyelet means onto which the hooks which are themselves permanently affixed to the elastic type panel member of the brassiere removably affix to the brassiere shoulder strap.

Figure 4:
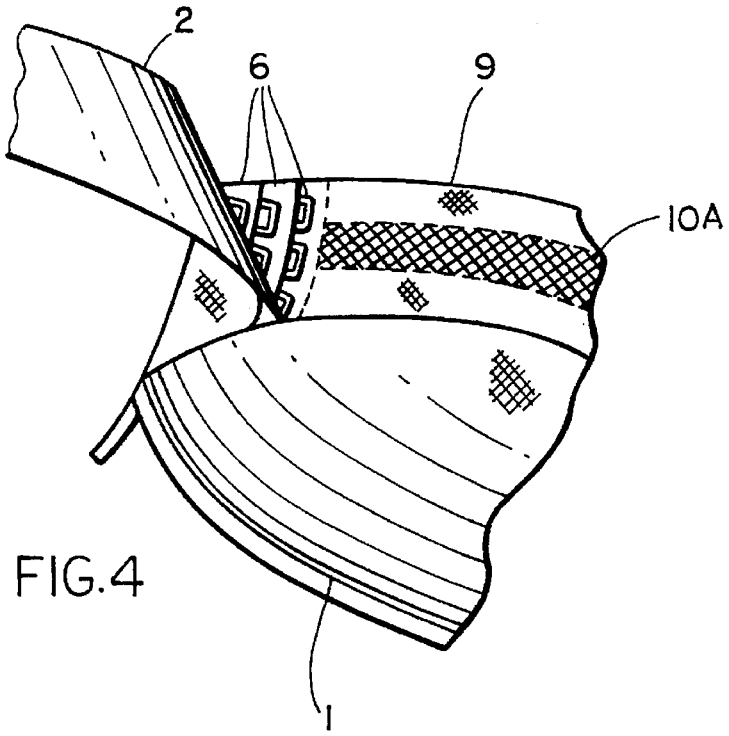

FIG. 4 is a modification of FIG. 3 in which the brassiere shoulder strap is partially returned to its normal resting position, in which position the hooks are hidden from view behind the said brassiere shoulder strap, as would be the eyelets after being removably secured to the hooks.

FIG. 5 is a further modification of FIG. 3 in which the brassiere shoulder strap is now totally returned to its normal resting position, in which position both the eyelets and hooks are completely hidden from view behind the said brassiere shoulder strap.

FIG. 6 is a top view and a cross section view of the contoured pads to be inserted into the breast retention cups of the brassiere.

Figure 7:
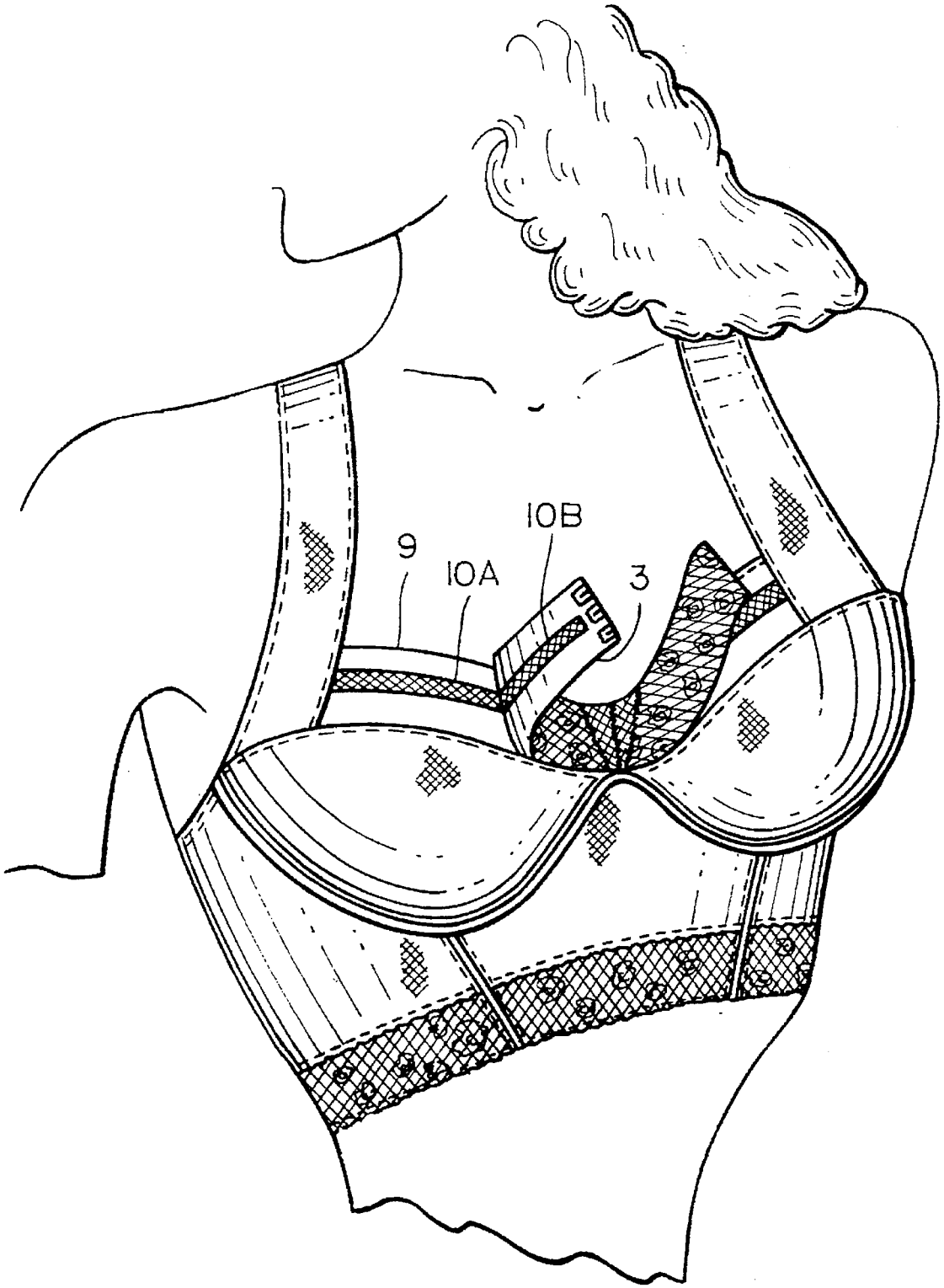

FIG. 7 is a modified view of FIG. 2 in which the mating velcro strips of both the elastic type panel member of the brassiere and the upper breast surface contact soft fabric panel of the brassiere are each depicted.

Figure 8:
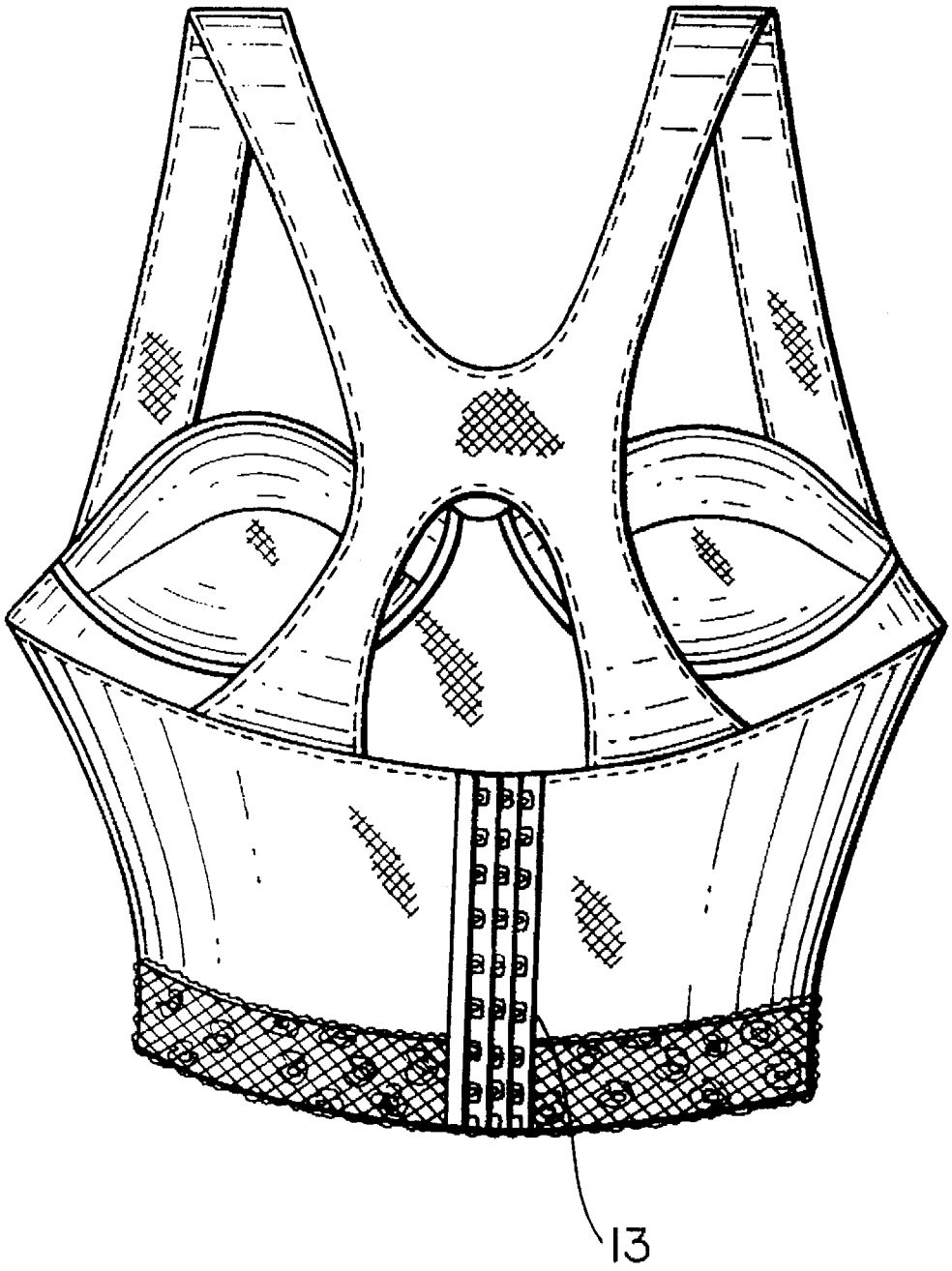

FIG. 8 is a rear view of one embodiment of a brassiere incorporating the invention with a posture enhancing back panel of the brassiere.

Figure 9:
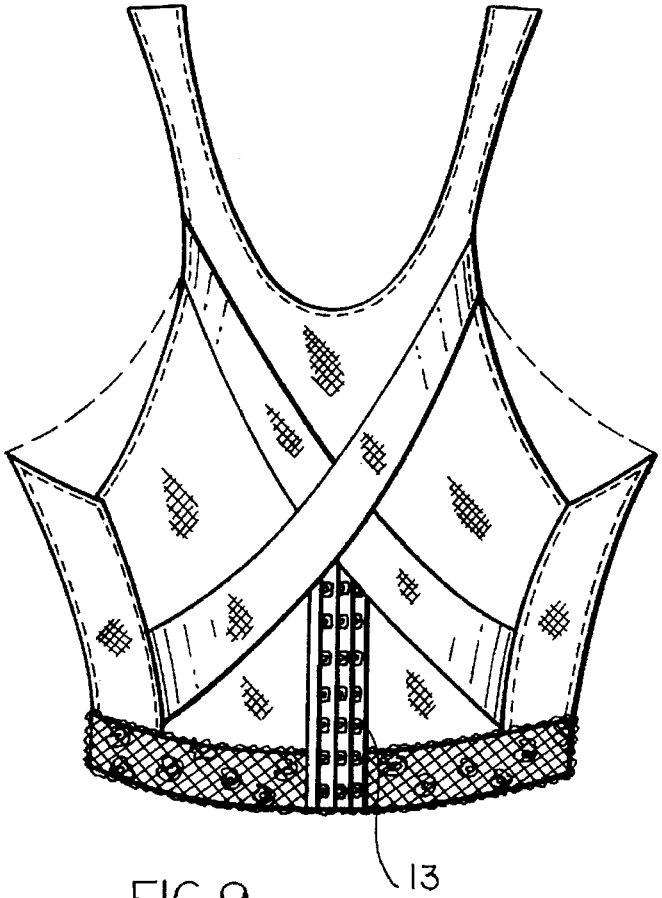

FIG. 9 is a rear view of an alternate embodiment of a brassiere incorporating the invention with a posture enhancing back.

Figure 10:
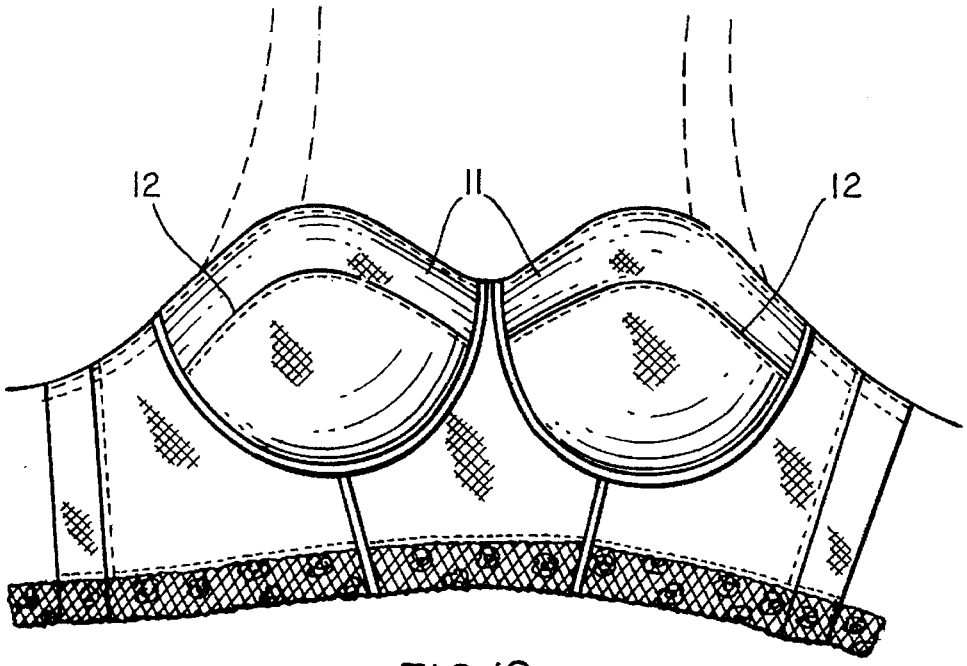

FIG. 10 is a rear view of one embodiment of a brassiere incorporating the invention with the back of the brassiere structure remove, depicting the inside surface of the breast retention cups, and the slots therein into which are to be inserted the contoured pads.

LIST OF DRAWING REFERENCE NUMBERS

1. Brassiere breast cup.
2. Brassiere shoulder strap.
3. Elastic type panel member means of providing positive downward pressure on the breast and thereby restraining upward movement of breast.
4. Front of slot opening for insertion of contoured pads.
5. Hooks for removably affixing elastic means of providing positive downward pressure 3 to Brassiere shoulder strap 2.
6. Multiple rows of eyelets onto which hooks 5 removably affix.
7. A depiction of a pad insert.
8. A cross section of a pad insert.
9. A panel of soft fabric material in direct contact with the skin of the breast located between the breast and the relatively rough surface of the elastic member 3.

10A. A strip of velcro type material along the full length of the soft panel 9, from brassiere shoulder strap to shoulder strap, at the middle of the said soft panel in relation to the pad slot 4 and the upper most edge of the elastic member 3 nearest the otherwise exposed chest of the wearer.

10B. A strip of velcro type material along the full length of the underside of the elastic member 3, at the middle of the said underside of the elastic member, in relation to the pad slot 4 and the upper most edge of the elastic member 3 nearest the otherwise exposed chest of the wearer, which velcro strip 10B mates with velcro strip 10A.

11. Pocket attached to brassiere breast cup on top and sides only.
12. Slot opening from the interior side of the breast cup of the brassiere to allow entry into pocket 11 for insertion in an upward direction of pad insert.
13. Means for removably and variably affixing the two mating sections of the back of the brassiere to thereby enable the brassiere to be secured to the said torso of the wearer with varying degrees of pressure and stress on the said torso to which the brassiere is affixed.

DESCRIPTION OF THE INVENTION

As depicted in FIGS. 1 through 10, my invention is essentially a brassiere specifically for use by female athletes while performing active, vigorous physical exercise.

My invention is comprised of modifications (namely, elastic members 3, means for variably and removably affixing the said elastic type panel member to the shoulder strap of the brassiere, velcro restraining strips 10A and 10B, breast pads 9, breast pad slots 4) to a traditional standard brassiere, which standard brassiere is comprised essentially of breast cups 1 affixed to shoulder straps 2, all of which are then affixed to a means to allow the combination to be removably affixed to the body of the wearer of the brassiere.

The preferred embodiment of the invention means for variably and removably affixing the said elastic type panel member to the shoulder strap of the brassiere is a row of hooks 5 and a series of eyelets 6 to which the hooks 5 are variably and removably affixed.

The most preferred alternate embodiment of the invention means for variably and removably affixing the said elastic type panel member to the shoulder strap of the brassiere is a patch of velcro positioned in place of and in lieu of the hooks 5, and an addition patch of velcro positioned in place of and in lieu of the eyelets 6, with the said two velcro patches mating with each other instead of the hooks being affixed to the eyelets.

There are many other and additional embodiments of the means for variably and removably affixing the said elastic type panel member to the shoulder strap of the brassiere.

In my invention elastic members 3 are permanently affixed on the upper surface of the brassiere breast cups 1 and removably and variably affixed to the brassiere shoulder straps 2.

In the preferred embodiment of the invention, permanently affixed to the ends of the elastic type panel member 3 which are located in closest proximity to the shoulder straps 2 is a single row of hooks 5, which hooks 5 are variably and removably affixed to one of the multiple rows of eyelets 6 which are permanently affixed to soft fabric panel 9 and located underneath the shoulder straps 2.

The elastic type panel members 3 cause positive downward pressure on the breasts thereby holding and containing and restraining the breast within the breast cups 1 and precluding oscillation of the breasts during vigorous physical exercise of the wearer.

The extent or the level or degree of pressure on the breasts is controlled by the amount of tension in the elastic members 3, which tension is controlled by the relative positions (to each other) of the components of the means employed to variably and removably affix the elastic type panel member to the shoulder strap; the greater the tension in the elastic member 3, the greater the pressure on the breasts and the greater the restraint, thereby precluding movement of the breasts.

In the preferred embodiment of the invention, in which the said means is a single row of hooks 5, which hooks 5 are variably and removably affixed to one of the multiple rows of eyelets 6, it is the specific row of eyelets onto which the row of hooks is affixed which determines the extent of the pressure; the greater the tension in the elastic member 3, the greater the pressure on the breasts and the greater the restraint, precluding movement of the breasts.

In the most preferred alternate embodiment of the invention, in which the said means is two patches of mating velcro surfaces positioned in place of the row of hooks 5 and row of eyelets 6, it is the extent of overlap of the two mating velcro patch surfaces which determines the extent of the pressure; the greater the tension in the elastic member 3, the greater the pressure on the breasts and the greater the restraint, precluding movement of the breasts.

In addition to the hooks 5 and eyelets 6 at the shoulder strap 2 edges of the elastic members 3 in the preferred embodiment of the invention, (or two rows of mating velcro patch surfaces in the most preferred alternate embodiment of the invention), the elastic members 3 may be secured in position along the entire upper surface of the breast and along the entire length of the soft fabric panel 9 by means of a separate velcro strip 10A permanently affixed to the soft fabric panel 9 interfacing and mating with a companion velcro strip 10B permanently affixed to the underside of the elastic member 3.

The upper surface of the interior of the breast cups 1 is bivalved to form a pocket 11 that opens through a slot 12 from below and from the rear or interior of the breast cup 1 to allow for insertion of the pads 7. Additional restraint from unwanted oscillation of the breasts is created by the insertion of these breast pads 7 into breast pad slots 12 which open from the interior side of the breast cup 1 of the brassiere allowing entry into pocket 11 for insertion in an upward direction of the breast pads 7. These breast pads provide multiple benefits to the wearer, including enhancement of both comfort and appearance.

OPERATION OF THE INVENTION

The device which is my invention, namely the brassiere for female athletes, is worn in a manner virtually identical to the wearing of a standard brassiere; the distinction of my invention in comparison to a standard brassiere is that my invention, when properly sized and worn, provides for full, firm and gentle support of the breasts by applying moderate downward pressure on the breasts of the female athlete during vigorous exercise.

Prior to the wearer dressing the brassiere on herself, the wearer selects the contoured pad 7 which is most comfortable to the wearer and achieves the appearance sought by the wearer. The wearer then inserts the contoured pads 7 through the slot 12 into the pocket 11. The wearer then dresses the brassiere onto herself in the customary manner.

In the preferred embodiment of my invention, after the brassiere is dressed on the wearer, and the wearer has selected the preferred torso pressure by coupling the means 13, the elastic members 3 are stretched and hooks 5 are affixed to the particular row of eyelets 6 as selected by the wearer for the extent of positive breast pressure desired. After the hooks 5 are affixed to the eyelets 6, the elastic member 3 is released by the wearer, causing the elastic member 3 to contract somewhat in length and to come into direct positive contact with soft fabric panel 9, at which time simultaneously velcro strip 10A mates with velcro strip 10B, thereby stabilizing the contact of elastic member 3 with the soft fabric panel and in turn, indirectly, with the breast.

In the most preferred alternate embodiment of my invention, after the brassiere is dressed on the wearer, and the wearer has selected the preferred torso pressure by coupling the means 13, the elastic members 3 are stretched and the mating velcro patches which are located in place of hooks 5 and eyelets 6 are overlapped with each other, and are placed in positive contact with each other as selected by the wearer for the extent of positive breast pressure desired. After the said mating velcro patches are mated with and affixed to each other, the elastic member 3 is released by the wearer, causing the elastic member 3 to contract somewhat in length and to come into direct positive contact with soft fabric panel 9, at which time simultaneously velcro strip 10A mates with velcro strip 10B, thereby stabilizing the contact of elastic member 3 with the soft fabric panel and in turn, indirectly, with the breast.

SUMMARY

This invention is of a brassiere for use by a female athlete, which brassiere, by unique use of elastic type panel members in the upper portion of the brassiere, removably and variably affixed by means at each end of each such elastic type panel member to the brassiere shoulder strap, prevents bouncing and oscillation of the breasts, and accomplishes this prevention of bouncing by compression downward from the upper surface of the breast; and further the upper surface of the brassiere has an enclosed bivalved pocket for the insertion of a contoured pad to optimize downward pressure distribution on the breast and to enhance appearance and comfort.

I claim:

1. A brassiere for a female athlete comprising:

left and right breast cups for supporting the breasts of the female;

means for securing the breast cups to the female;

the brassiere further having a mid-point between the breast cups for being disposed over the sternum and between the breasts of the female, and each cup having an upper fabric panel edge extending a length from the mid-point to an outer point, the outer point for being disposed over the upper lateral portion of each breast;

left and right elastic members disposed over each respective upper fabric panel edge, each elastic member having a relaxed-length that is shorter than the length of the respective upper fabric panel edge, and each elastic member having an inner end fixed to the mid-point, an outer end, and an interior longitudinal surface;

means for variably and removably fixing the outer end of each elastic member to the outer point of each respective breast cup; and means for fastening the interior longitudinal surface of each elastic member to the upper fabric panel edge of each respective breast cup;

wherein the elastic members provide a force that pushes down on the breasts when the brassiere is secured on the female and the outer ends are fixed to the outer points and the interior longitudinal surfaces are fastened to the upper fabric panel edges.

2. A brassiere according to claim 1, wherein the means for variably and removably fixing the outer end of each elastic member to the outer point of each breast cup comprises a row of hooks fixed to the outer end of each elastic member and multiple rows of eyelets fixed to the outer point of each breast cup, each row of eyelets for receiving the row of hooks.

3. A brassiere according to claim 1, wherein the means for variably and removably fixing the outer end of each elastic member to the outer point of each breast cup comprises a hook and loop fastener patch fixed at the outer end of each elastic member and a companion hook and loop fastener patch fixed at the outer point of each breast cup, wherein the hook and loop fastener patches may be overlappingly engaged in various positions to adjust the tension in the elastic members.

4. A brassiere according to claim 1, further comprising a pocket disposed on an upper portion of each breast cup, and a pad inserted in the pocket.

5. A brassiere according to claim 1, wherein the means for fastening the interior longitudinal surface of each elastic member to the upper fabric panel edge of each respective breast cup comprises a strip of hook and loop fastener material fixed to the interior longitudinal surface and a companion strip of hook and loop fastener material fixed along the upper fabric panel edge, wherein the strips of hook and loop fastener material engage when the outer end of the elastic member is attached to the outer point of the breast cup.

6. A brassiere according to claim 1, wherein the left and right elastic members are formed from a single strip of elastic material fixed to the mid-point of the brassiere.

* * * * *